US005103568A

United States Patent [19]

Canoy

[11] Patent Number: 5,103,568

[45] Date of Patent: * Apr. 14, 1992

[54] ARCHERY SIGHTING DEVICE

[76] Inventor: Norman Canoy, P.O. Box 966, Clemson, S.C. 29633

[ * ] Notice: The portion of the term of this patent subsequent to Dec. 14, 2005 has been disclaimed.

[21] Appl. No.: 870,457

[22] Filed: Jun. 4, 1986

[51] Int. Cl.[5] ..... F41G 1/467; F41G 1/32; F41B 5/00

[52] U.S. Cl. ..... 33/265; 33/241; 124/87

[58] Field of Search ..... 33/265, 241, 348; 116/73, 307, 315, DIG. 21; 235/128; 124/87

[56] References Cited

U.S. PATENT DOCUMENTS 1,358,698 11/1920 Beskow ..... 116/73
3,450,122 6/1969 Diamond ..... 33/265
3,670,422 6/1972 Stebbins et al. ..... 33/265
3,822,479 7/1974 Kowalski ..... 33/265
4,020,560 5/1977 Heck ..... 33/265
4,136,462 1/1979 Topel ..... 33/265
4,400,887 8/1983 Mason ..... 33/265
4,567,668 2/1986 King et al. ..... 33/265
4,587,945 5/1986 Little ..... 124/87

OTHER PUBLICATIONS

*Bow & Arrow*, Oct. 1983, p. 62, Class 124; Subclass 87.

*Primary Examiner*—William A. Cuchlinski, Jr.
*Assistant Examiner*—C. W. Fulton
*Attorney, Agent, or Firm*—Bailey & Hardaway

[57] ABSTRACT

An archery sight having a frame with juxtaposed slots mounting adjustable sighting pins within a sighting port of the frame.

8 Claims, 2 Drawing Sheets

FIG. 2
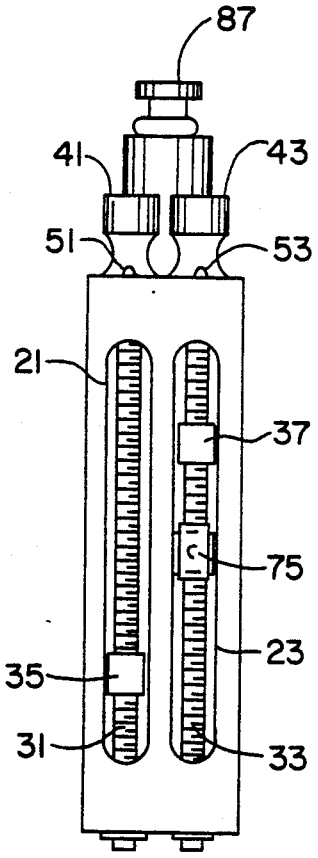
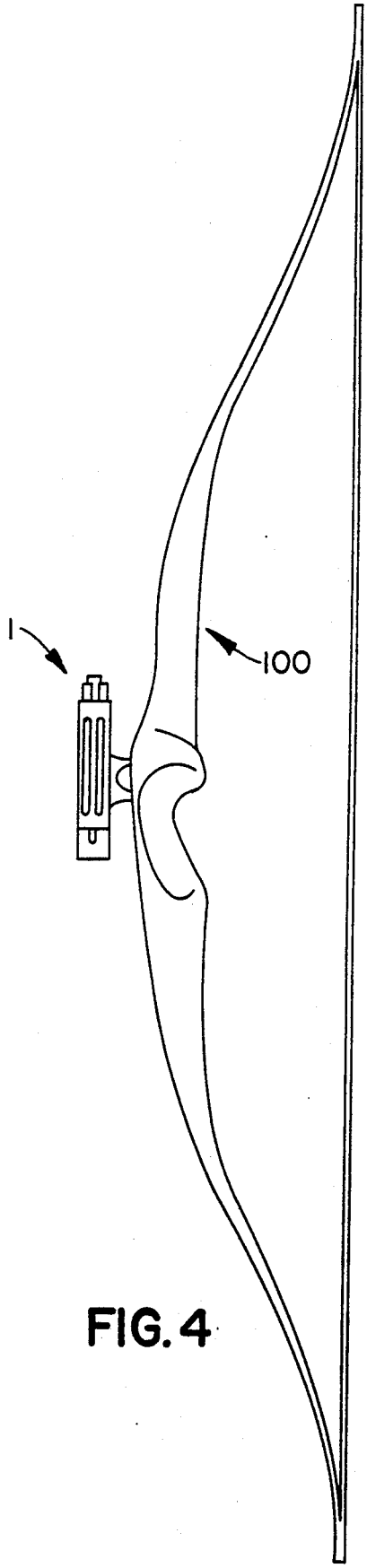
FIG. 4

ARCHERY SIGHTING DEVICE

BACKGROUND OF THE INVENTION

This invention relates generally to the art of archery and more particularly to a novel sighting apparatus for use with an archery bow.

In the field of archery various devices have been envisoned and utilized so as to improve upon the mere instinctive sighting of an arrow with a bow. Since the mere alignment of an arrow with a target does not provide for the natural fall of the arrow or for the effect of windage on the arrow, it is necessary for the archer to have a very keen instinct as to the distance and windage or to somehow compensate for such lack of instinct. Guidance or sighting devices have been provided to assist in the establishment of elevation and windage adjustment for the proper sighting with an archer's bow.

Various prior art devices have been devised for assisting an archer in this regard.

U.S. Pat. No. 3,365,800 to Carella describes a plurality of sighting pins with circular sights at the end thereof for use at varied distances. U.S. Pat. No. 4,026,032 describes a similar apparatus having individual adjustment for each sighting pin to provide for windage. U.S. Pat. No. 3,163,938 to R. J. Reynolds discloses a sighting pin which is moveable along a slide having indicia thereon as to appropriate yardage.

U.S. Pat. No. 2,574,599 to Stieber describes a sighting device having a plurality of sighting slots vertically aligned along the length of a bow to provide for sighting at various distances associated with each individual slot.

U.S. Pat. No. 3,696,517 to Larson discloses a sighting apparatus utilizing both sighting pins and a sighting window.

U.S. Pat. Nos. 2,900,973 and 3,865,095 respectively to Diehr and Helmick disclose sighting devices which are integral parts of a bow.

U.S. Pat. No. 3,056,206 to Moore discloses a sighting apparatus having a moveable plate mounted on rods attached to the bow with sighting devices mounted on the slideable plate. U.S. Pat. No. 4,170,071 to Mann describes the use of sighting pins having light emitting diodes at the ends thereof.

While these prior art devices provide assistance to the archer, a need still exists to provide greater flexibility for the archer with regard to compensating variables such as windage, distance, varying bows, bow strings, seasonal conditions, feather variations such as vanes, aerodynamic efficiency, and other changes which bring about the need for a change in the angle of trajectory of the arrow being shot.

SUMMARY OF THE INVENTION

It is thus an object of this invention to provide a novel archery sight.

It is a further object of this invention to provide an archery sight providing versatility not heretofore available.

It is a still further object of this invention to provide an archery sight which provides for adjustment such adjustment being indicative by means other than visual observation.

These as well as other objects are accomplished by an archery sight formed of a rectangular frame having a sighting port in the central portion thereof. Sighting pins are arranged within the sighting port and are moveable within juxtaposed pairs of guide slots in each side of the frame with each sighting pin moveable upon screws which are individually rotatable within the guide slots.

BRIEF DESCRIPTION OF THE DRAWINGS

FIG. 2 of the drawings is a left side view of FIG. 1 of the drawings.

FIG. 4 of the drawings is a perspective view illustrating the archery sight in combination with a bow.

DETAILED DESCRIPTION

In accordance with this invention it has been found that an archery sight is provided which permits sighting with a plurality of sighting pins each individually adjustable and with adjustment indicated not only by means of visual observation but by audibly determining the extent of movement of each individual sighting pin. Additionally, in accordance with this invention it has been found that sighting pins may be housed within a sighting port which also permits better observation and estimation of distances to target locations. Various other features and advantages will become apparent from a reading of the following description given with reference to the various figures of drawing.

Figure 1:
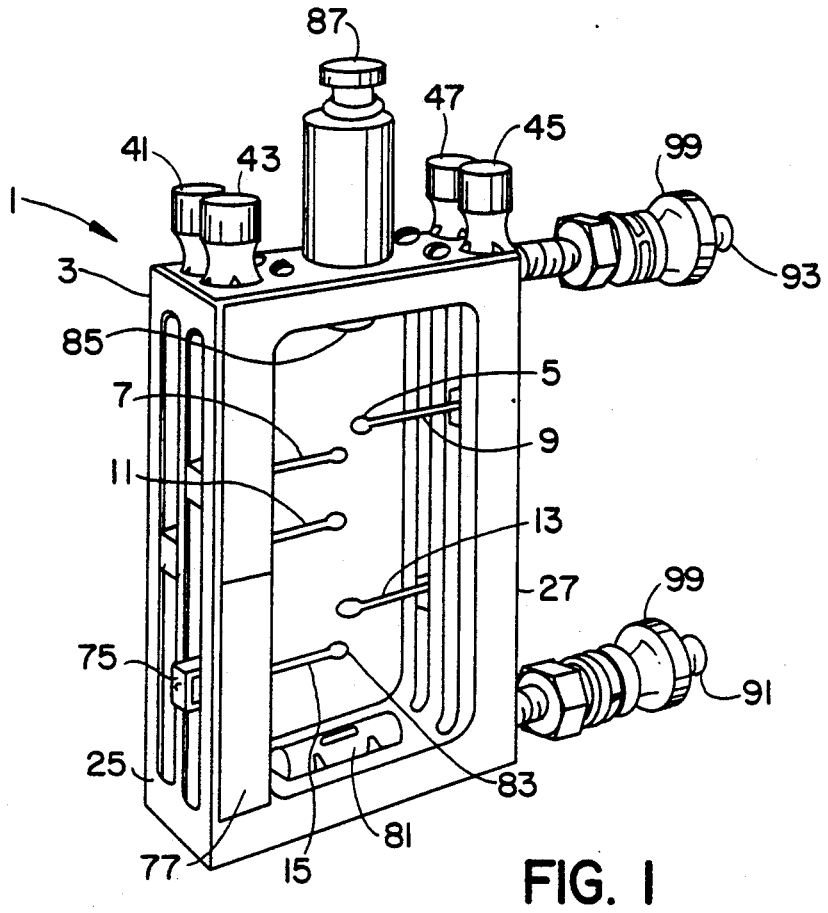
FIG. 1 of the drawings is a perspective view of the sighting device of this invention.

FIG. 1 of the drawings illustrates the archery sight 1 in accordance with the invention. The sight is formed from a generally rectangular frame 3 which has a hollow sighting port 5 in a central portion thereof. The sighting port 5 has a plurality of sighting pins 7, 9, 11, 13, and 15 mounted therein. The mounting of the sighting pins within sighting port 5 may be better understood by referring to FIG. 2 of the drawings which is a view along the left side of FIG. 1.

As FIG. 2 is viewed it is understood from viewing FIG. 1 that the description given with regard to FIG. 2 is equally applicable to either the left or right hand view of FIG. 1 with the exception of sighting pin 15.

In viewing FIG. 2 it is seen that frame 3 defines a pair of sight guide slots 21 and 23 through a longitudinal edge 25 thereof. It is understood that edge 25 as viewed in FIG. 1 and edge 27 are similar with edge 27 having a pair of sight guide slots juxtaposed to sight guide slots 21 and 23.

Mounted within sight guide slots 21 and 23 are screws 31 and 33 having nuts 35 and 37 riding respectively thereon. It is seen that nuts 35 and 37 are retained in position within slots 21 and 23 and are not able to rotate therein. Screws 31 and 33 are mounted within the slot so that they rotate freely therein but do not move with respect to the slot. Nuts 35 and 37 thus move longitudinally within slots 21 and 23 depending upon the direction of rotation of its associated screw. From viewing FIG. 1 it is seen that sighting pin 7 rides upon nut 35 while sighting pin 11 rides upon nut 37. In a similar manner sighting pins 9 and 13 ride within symmetrically positioned screws within slots along the edge at 27. Additionally sighting pin 15 rides upon screw 33 but has additional provisions which will be further described below.

Screws 31 and 33 are adjustable by means for individually rotating 41 and 43 associated screws, while screws mounted within edge 27 are likewise adjustable by means 45 and 47. Means 41, 43, 45 and 47 are preferably thumb nuts and are preferably provided with slots as shown in FIG. 2, 51 and 53. Viewing FIG. 3 of the drawings which is a top view of FIG. 1 it is seen that each thumb screw is provided with a detent spring 61 which rides along the periphery thereof and catches and sonically indicates engagement with groove 51. Grooves such as 51 are preferably provided at 90 degree locations about the periphery of thumb nut 41 so that an archer may rotate the thumb nut and by audibly distinguishable sonic vibrations from detention spring 61 know approximately the distance variation achieved by the degree of rotation.

Not only does sighting pin 15 ride upon screw 33, but it also rides upon clasping nut 75. Clasping nut 75 can be disengaged from screw 33 by digitally pressing thereon. Such pressing frees clasping nut 75, thereby allowing sighting pin 15 to be manually moved along screw 33 without rotation of the screw 33. Sighting pin 15 is thus a floating pin which may be utilized for long distance sighting by demarcation placed upon panel 77. Floating pin 15 thus may provide for quick adjustment for distance variations at long distances.

It is understood that all sighting pins 7 through 15 may be calibrated for various bow and string types on a calibrated range as is conventionally done with other archery sights. It is understood, however, that by having the sighting pins within a sighting port 5 that the sighting port itself may be utilized to gauge distances in the field by viewing the size of objects such as deer through the port 5.

Various other preferred features in the sight of this invention include a bubble level 81 mounted on the bottom edge of sighting port 5 to aid the archer in determining the vertically alignment of the bow. Level 81 is removably mounted so as to permit removal during tournament competition.

Additionally, each of the individual sighting pins 7 through 15 have a bead or demarcation 83 at the end thereof and each demarcation or bead 83 of each individual sighting pin lies within a single plane.

Mounted on the sight in the upper portion thereof is a light source 85 which illuminates all sighting pins along the plane where each bead 83 is located. Lighting source 85 is preferably a light emitting diode with adjustable and variable illumination brought about by rotation of means 87. This lighting means 85 is perferred for use during conditions of twilight and other conditions of dim lighting.

Figure 3:
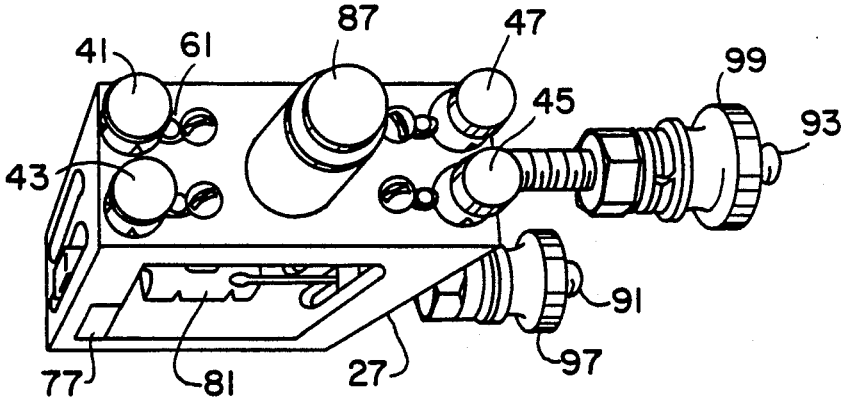
FIG. 3 of the drawings is a top view of FIG. 1.

The apparatus 1 is mounted upon an archery bow by means 91 and 93 as illustrated in FIGS. 3 and 4 of the drawings. It is seen that means 91 and 93 are adjustable on bracket 95 such that adjustment for windage may be provided by adjusting the thumb nuts 97 and 99 thereof.

It is seen that the sighting device of this invention provides a novel apparatus for sighting with an archery bow and which provides versatility and adjustment not heretofore available. The apparatus of this invention provides audibly detectable sonic indications of sight adjustment as well as providing lighting and level indications for the sight thereof. As many variations will become apparent to those of skill in the art from a reading of the above description such variations are embodied within the spirit and scope of this invention as is measured by the following appended claims:

That which is claimed:

1. An archery sight, comprising:

a generally rectangular frame defining a sighting port in a central portion thereof and a pair of juxtaposed sight guide slots along each longitudinal edge thereof;

a rotatable screw longitudinally mounted through the length of each slot;

a nut riding on each screw guided by and moveable longitudinally within its respective slot;

a sighting pin attached to each said nut, each sighting pin extending into a central longitudinal portion of said sighting port; and means for individually rotating each said screw and thus longitudinally moving the respective sighting pin through said sighting port.

2. The archery sight according to claim 1 wherein said means for individually rotating comprises means for sonically indicating the degree of rotation thereof and thus the extent of longitudinal movement of the associated sighting pin.

3. The archery sight according to claim 1 further including a floating sighting pin attached by a clasping nut to one of said screws wherein said clasping nut can be released so that said floating sighting pin can be manually moved longitudinally along said screw without rotating said screw.

4. The archery sight according to claim 1 further including a removable bubble level mounted within said sighting port.

5. The archery sight according to claim 1 further including a light source for illuminating said sighting pins.

6. The archery sight according to claim 1 further including sighting demarcation at the tip of each said sighting pin and wherein all said sighting pins have said sighting demarcation within a single plane.

7. The archery sight according to claim 1 including means for mounting said frame upon an archery bow wherein said longitudinal edge of said archery sight is in longitudinal alignment with the length of said bow.

8. The archery sight according to claim 7 wherein said mounting means are adjustable to provide for windage adjustment.

* * * * *